US005860489A

United States Patent [19]

Krause

[11] Patent Number: 5,860,489

[45] Date of Patent: Jan. 19, 1999

[54] TRAVELLING SCAFFOLDING

[75] Inventor: Guenther Krause, Alsfeld, Germany

[73] Assignee: Krause-Werk GmbH & Co. KG, Alsfeld-Altenburg, Germany

[21] Appl. No.: 750,551

[22] PCT Filed: May 12, 1995

[86] PCT No.: PCT/EP95/01804

§ 371 Date: Dec. 9, 1996

§ 102(e) Date: Dec. 9, 1996

[87] PCT Pub. No.: WO95/34726

PCT Pub. Date: Dec. 21, 1995

[30] Foreign Application Priority Data

Jun. 10, 1994 [DE] Germany ..... 9409416 U

[51] Int. Cl.[6] ..... E04G 1/20

[52] U.S. Cl. ..... 182/17

[58] Field of Search ..... 182/12–17, 179.1

[56] References Cited

U.S. PATENT DOCUMENTS

| | | | |
|---|---|---|---|
| 3,516,512 | 6/1970 | Kupke | 182/16 |
| 3,752,261 | 8/1973 | Bushnell | 182/17 |
| 4,967,733 | 11/1990 | Rousseau | 182/16 |
| 5,022,490 | 6/1991 | Wyse | 182/17 |

*Primary Examiner*—Alvin Chin-Shue

*Attorney, Agent, or Firm*—Flynn, Thiel, Boutell & Tanis, P.C.

[57] ABSTRACT

Travelling scaffoldings must cope with manifold tasks and especially be characterized in that their resting surface must adapt to various conditions. In the disclosed scaffolding, the roller-bearing traverses (16) are subdivided into two parts and the parts **(16*a*, 16*b*) are interconnected and slanted in relation to the rectangular base structure of the scaffolding, so that the widening traverses (15)** allow the distance between the rollers to be increased in two mutually perpendicular directions.

8 Claims, 3 Drawing Sheets

TRAVELLING SCAFFOLDING

FIELD OF THE INVENTION

The invention relates to a travelling scaffolding manufactured out of prefabricated structural parts, essentially comprising vertical frame elements assembled out of posts, horizontal, rectangular platforms defining the outline of the scaffolding, which platforms can be placed onto crossbars in the frame elements, which crossbars can, if necessary, also be used as ladder rungs, and can be equipped with openings and define longitudinal and/or transverse edges, diagonal longitudinal and/or transverse reinforcement, longitudinally and/or transversely extending railing and/or in between spars fastened to the posts, and rollers for moving the scaffolding, which rollers are mounted in pairs on a horizontal beam-shaped slanting traverse belonging to each frame element and provided on the lower end of the frame element, the rollers each being fastened to the free end of a widening traverse, which is fastened along the slanting traverse and can be moved parallel on the same, and the longitudinal axis of which is parallel to the associated one of the slanting traverses, preferably, however, it is in alignment with the same.

BACKGROUND OF THE INVENTION

Scaffoldings of this type are often very high and for setup must have a sufficient stability without which the outer outline dimensions specified by the platform would have to be enlarged beyond the degree of technologically required and permissible for transport. It is therefore a familiar practice, and regulated by pertinent codes, that the stability of the base of the scaffolding is increased by being able to pull the rollers arranged in pairs out of their transport position apart from each other, thus increasing the base area when setting up the scaffolding. The roller, however, cannot be moved additionally in a direction perpendicular to the one specified by the widening traverses. For this purpose, additional extension traverses would have to be inserted and thus the entire arrangement would be significantly more complicated. However, the expansion of the base in the perpendicular direction is actually just as desirable.

SUMMARY OF THE INVENTION

The basic purpose of the invention is therefore to design a travelling scaffolding of the type described above with simple means so that the base can be increased in two horizontal directions perpendicular to one another during the operation compared with the outline permissible and decisive for the transport without requiring significant additional work and expense.

The purpose is attained according to the invention by each slanting traverse having two pieces, which are provided angled with respect to one another, and which in the outline of the scaffolding, on the one hand, are arranged symmetrically to one another and inwardly angled, and, on the other hand, each have one of the widening traverses which can be moved angled outwardly along the longitudinal axis of the respective piece of the slanting traverse.

A separate extension system transverse to an already existing system for widening with the structural input necessary for operation is avoided in this simple structure, nevertheless the purpose is attained to an extent sufficient for such scaffoldings. Depending on the degree the pieces are angled, the base can be more or less extensively enlarged in the one or other direction, thus improving the stability of the scaffolding. The arrangement does not depend on the construction of other participating structural elements and is equally suited for entirely different systems.

The angled pieces can be designed to abut one another or can be connected to one another by at least one further piece of the slanting traverse, which further piece is preferably parallel to the cross bars, and can, for example, be screwed together, jointed by means of an angled plate, or can be welded together, other designs are also possible. Independent of the special design, care must be taken in every case that the connecting points of the pieces are safely constructed. This, however, is in view of the machine elements available in this field and the state of the welding technique, a problem of a subordinate nature easily mastered by a man skilled in the art.

A particularly advantageous invention is that the pieces and widening traverses are designed in cross section as a preferably rectangular, hollow profile piece. Such profiles can be manufactured with a high quality and inexpensively, for example, via an extrusion process.

It is advantageous when each vertical pipe piece for the support of the associated roller is provided on the outer ends of the widening traverses, moreover, the roller can be replaced with support feet and can be designed to elevationally adjust.

BRIEF DESCRIPTION OF THE DRAWINGS

The invention will be discussed in greater detail hereinafter in connection with one exemplary embodiment and the drawings.

DETAILED DESCRIPTION

Figure 1:
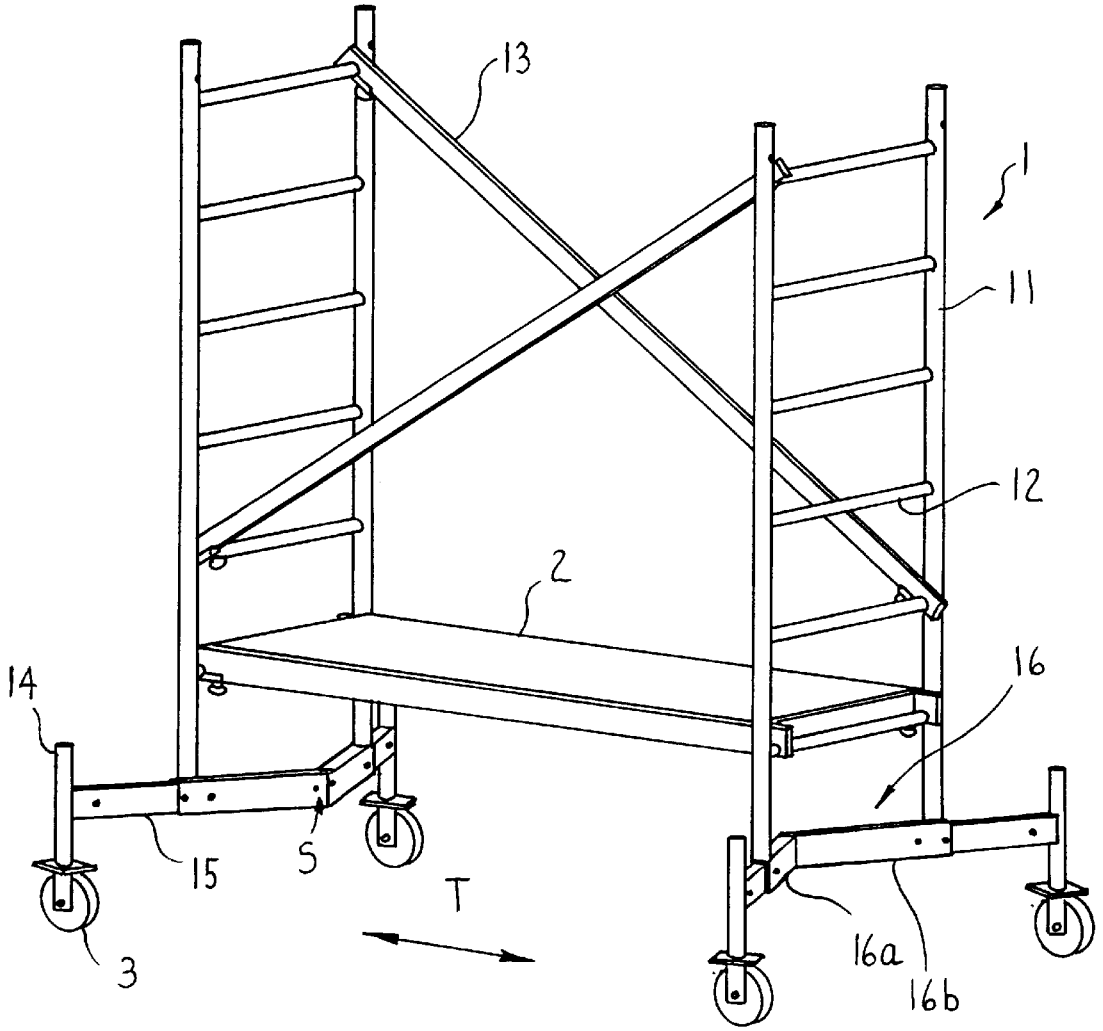
FIG. 1 shows a scaffolding of the invention in a complete overview in a three-dimensional illustration.

A travelling scaffolding according to the invention consists, first of all, of a system of vertical frame elements 1 manufactured out of parallel posts 11, whereby several frame elements 1 can be connected one above the other, for example by providing plug bolts at the (upper) ends of their posts, onto which plug bolts the (lower) ends of the next-higher posts 11 can be placed when they, as is conventional, consist of (circularly cylindrical) pipes. The vertical frame elements 1 are (here) connected to each other through a horizontal platform 2, which rests on crossbars 12 of the vertical frame elements and are locked to these in a suitable manner. The platform 2 can be equipped with an opening, which can be designed, if necessary, also as closable by means of a flap. The opening makes it possible to use the crossbars 12, which are welded at a narrow spacial dimension between the posts 11, as ladder rungs and to forego separate steps. The details are known and are only partially illustrated in the drawing.

The scaffolding is sufficiently reinforced by means of diagonal, longitudinal reinforcements 13, of course, in addition, it is also possible to provide transverse reinforcements, which, however, are not needed here because of the close succession of the welded crossbars 12. The longitudinal reinforcements 13 are fastened to the crossbars 12.

It is possible to provide railing spars for safety reasons. The platform 2 can be defined by longitudinal and transverse edges. The details of which have no relationship to the invention and are left out of the drawing.

Rollers 3 essentially permit the scaffolding to be able to be moved in its longitudinal direction T and are supported with a bearing in a vertical pipe piece 14.

Widening traverses 15 are designed in cross section with a (elevational-) rectangular hollow profile, which can in each case be moved in a slanting traverse 16, which is also (elevational-) rectangular in cross section.

Figure 2:
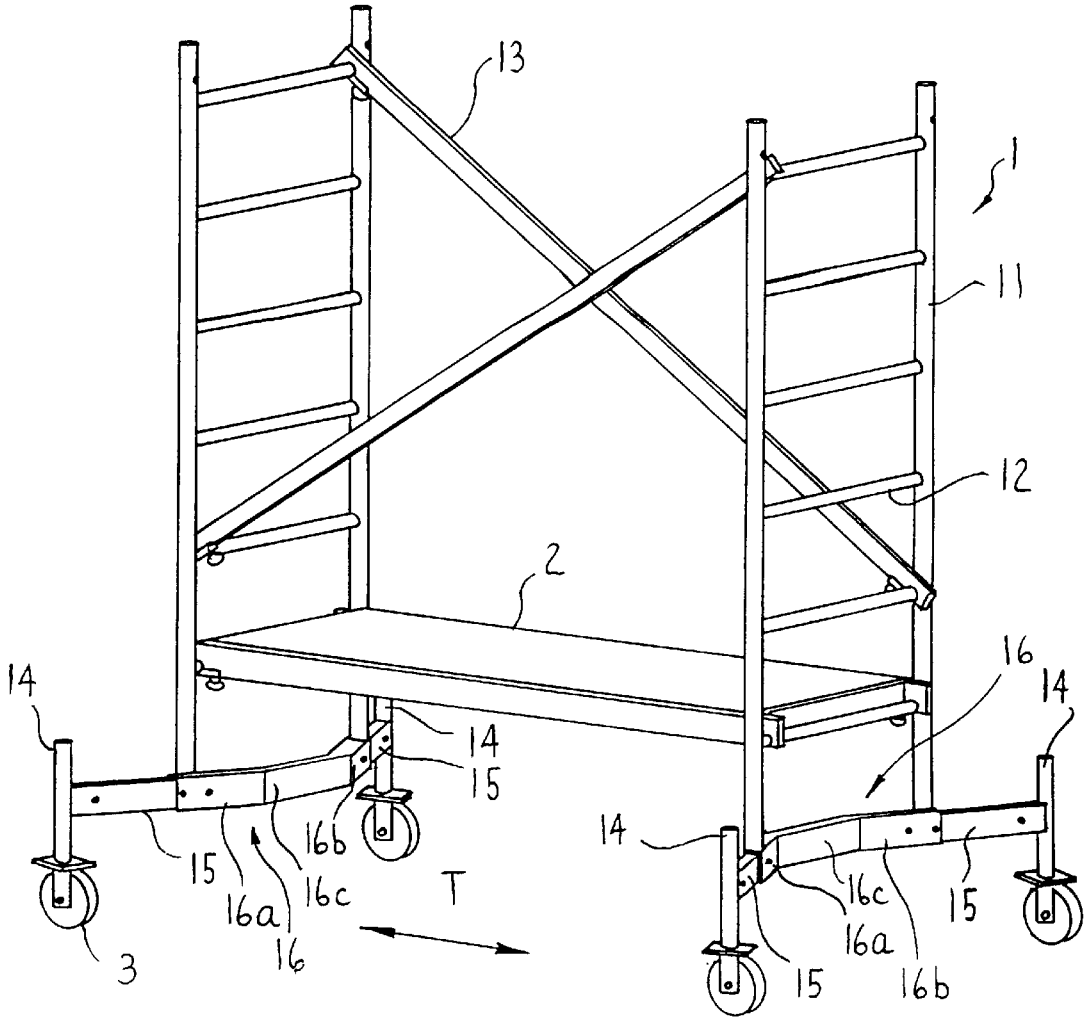
FIG. 2 shows a modification of the scaffolding.
Figure 3:
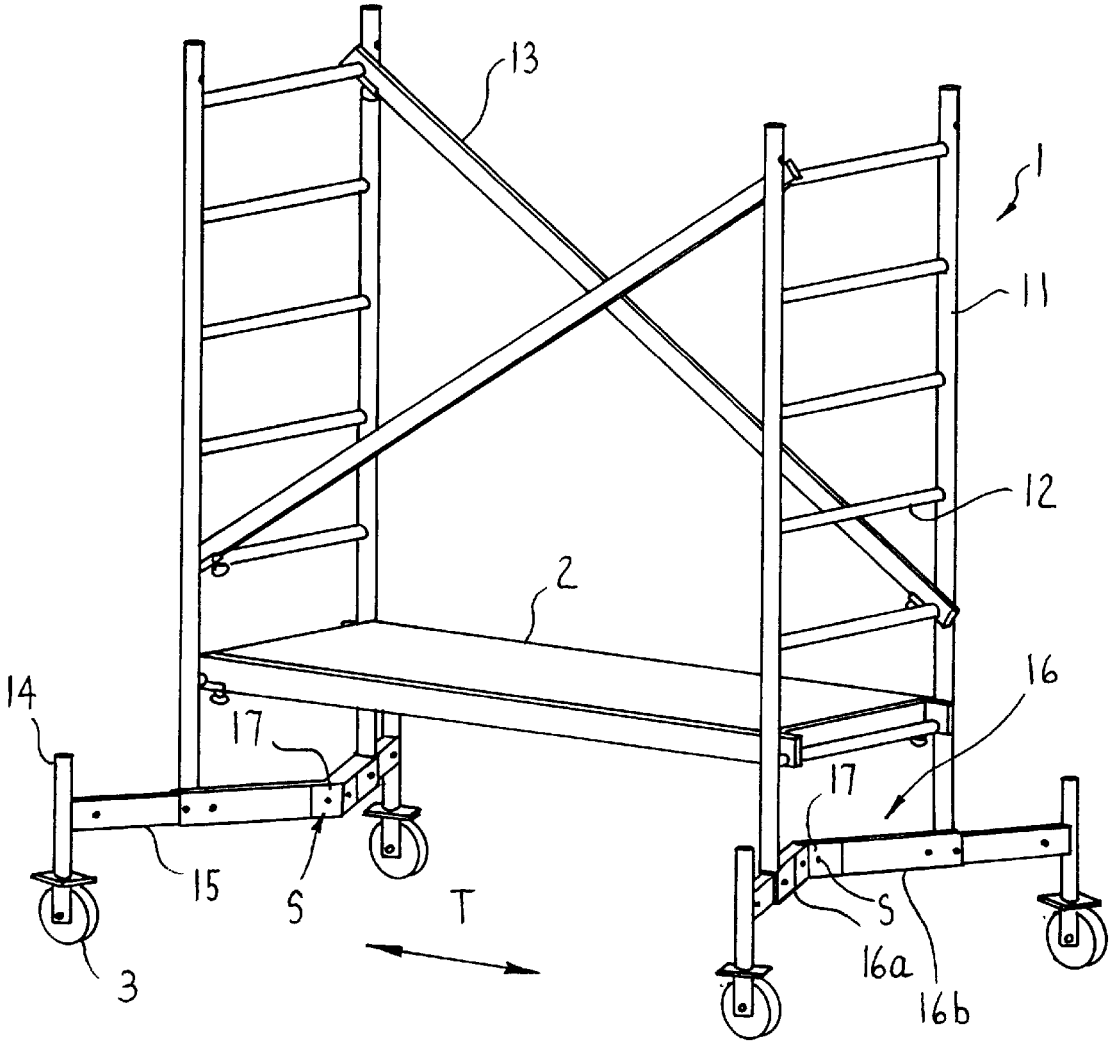
FIG. 3 shows a second modification of the scaffolding.

The slanting traverse 16 consists of two pieces 16*a*, 16*b*, which are connected at two abutting ends thereof. (FIG. 1). The slanting traverse pieces 16*a*, 16*b* may also be connected through a further piece 16*c* which is parallel to the crossbars 12 (FIG. 2). Screw connections S are indicated in the drawing, which rigidly connect these ends through an angled plate 17 moved into the pieces 16*a*, 16*b*. A lower end of one of the posts 11 is fastened to another end of the pieces 16*a*, 16*b*, and the associated widening traverse 15 is longitudinally movably supported on the other end.

The drawing easily illustrates the arrangement of the pieces 16*a*, 16*b*, they are arranged—in the top view—directed angled inwardly of the scaffolding on the posts 11 so that the widening traverses 15 are moved angled outwardly, and, in this manner, enlarge the supporting base of the scaffolding in both length and width.

I claim:

1. A travelling scaffolding manufactured out of prefabricated structural parts, comprising:

(a) a plurality of vertical frame elements each assembled out of pairs of vertical posts and a plurality of crossbars extending between each pair of posts, the crossbars being adapted for use as ladder rungs, (b) at least one horizontal, rectangular platform determining the outline of the scaffolding, the platform being placed onto the crossbars of the frame elements and being equipped with openings, the platform defining longitudinal and transverse edges of the scaffolding, (c) means for reinforcing the vertical frame elements to provide structural stability, (d) at least one of longitudinally and transversely extending railings fastened between posts of frame elements, and (e) a base for the scaffolding, the base comprising a plurality of horizontally slanting beam-shaped traverses connected to a lower end of each of the frame elements, two elongate widening traverses fastened to each of the slanting traverses, each widening traverse having a free end, and rollers respectively mounted at the free ends of the widening traverses for moving the scaffolding, (f) each of the slanting traverses having two connected elongate pieces angled with respect to one another, the two pieces being arranged symmetrically to one another and inwardly angled forming a V-shape, each slanting traverse being separate and spaced from each other, each of the two pieces being connected to one of the widening traverses, the widening traverses being movable outwardly along a longitudinal axis of the respective piece, one of the two widening traverses being parallel to one of the two pieces, the second of the two widening traverses being parallel to the second of the two pieces, the longitudinal axis of the one widening traverse being parallel to the longitudinal axis of the one piece, the longitudinal axis of the second widening traverse being parallel to the longitudinal axis of the second piece.

2. The travelling scaffolding according to claim 1, wherein at least one further piece of the slanting traverse connects the two pieces, the further piece extending parallel to the crossbars.

3. The travelling scaffolding according to claim 1, wherein the two pieces are screwed together.

4. The travelling scaffolding according to claim 3, wherein at least one angled plate connects the pieces and is screwed thereto.

5. The travelling scaffolding according to claim 1, wherein the pieces are welded together.

6. The travelling scaffolding according to claim 1, wherein cross sections of the two pieces and cross sections of the widening traverses each have a rectangular hollow profile.

7. The travelling scaffolding according to claim 1, wherein a vertical pipe piece for supporting the associated roller is provided on the outer, free ends of the widening traverses.

8. A mobile scaffolding, comprising:

a first frame element having first and second adjacent vertical posts, a second frame element having third and fourth adjacent vertical posts, a first plurality of bars extending between the first and second posts, a second plurality of bars extending between the third and fourth posts, the first, second, third, and fourth posts each having a lower end;

at least one rectangular platform connected to the first and second frame elements, the rectangular platform extending horizontally and defining a longitudinal axis of the scaffolding;

means for reinforcing the structural integrity of the scaffolding connected to the first and second vertical frame elements;

an elongate base consisting of: (a) a horizontally extending, elongate first beam connected to the lower end of the first post at a location adjacent the first end of the first beam, (b) a horizontally extending, elongate second beam connected to the lower end of the second post at a location adjacent the first end of the second beam, (c) a horizontally extending, elongate third beam connected to the lower end of the third post at a location adjacent the first end of the third beam, and (d) a horizontally extending, elongate fourth beam connected to the lower end of the fourth post at a location adjacent the first end of the fourth beam, the second ends of the first and second beams abut each other, the second ends of the third and fourth beams abut each other, the first, second, third and fourth beams extending at a nonperpendicular angle with respect to the longitudinal axis of the base, whereby the first and second beams form a first V-shape, the third and fourth beams form a second V-shape, the first and second V-shapes being seperate and spaced from each other;

means for expanding the base in a direction parallel to the longitudinal direction of the scaffolding and simultaneously in a direction perpendicular to the longitudinal direction of the scaffolding whereby the stability of the scaffolding is improved, the means for expanding including first, second, third, and fourth elongate base-widening members respectively extending from the first, second, third, and fourth beams, the first end of the first, second, third, and fourth members being movably connected to the respective first, second, third, and fourth beam, the first member being movable only along the longitudinal direction of the first beam, the second member being movable only along the longitudinal direction of the second beam, the third member being movable only along the longitudinal direction of the third beam, the fourth member being movable only along the longitudinal direction of the fourth beam; and means for moving the scaffolding mounted only at the second ends of the first, second, third and fourth beams.

* * * * *